US005536048A

United States Patent [19]

Orr

[11] Patent Number: 5,536,048

[45] Date of Patent: Jul. 16, 1996

[54] STORM COLLAR FOR VENTING HIGH EFFICIENCY FURNACES

[76] Inventor: Mark G. Orr, P.O. Box 19, Killbuck, Ohio 44637

[21] Appl. No.: 345,599

[22] Filed: Nov. 28, 1994

[51] Int. Cl.[6] ..... E04B 5/48

[52] U.S. Cl. ..... 285/42; 110/184; 52/199; 52/219; 454/44

[58] Field of Search ..... 110/184; 126/85 B, 126/307 R; 454/44; 285/42, 43, 44; 52/218, 219, 199, 198

[56] References Cited

U.S. PATENT DOCUMENTS

| | | | |
|---|---|---|---|
| 3,797,181 | 3/1974 | Nievelt | 285/43 |
| 4,437,687 | 3/1984 | Wilson | 285/42 |
| 4,512,119 | 4/1985 | Willoughby | 285/43 |
| 5,067,291 | 11/1991 | Evensen | 285/42 |

FOREIGN PATENT DOCUMENTS

| | | | |
|---|---|---|---|
| 1334458 | 7/1963 | France | 52/218 |

*Primary Examiner*—Thomas E. Denion

[57] ABSTRACT

A new and improved storm collar for venting high efficiency furnaces comprising a rounded collar having an upper periphery, a lower periphery, and an intermediate periphery therebetween. The rounded collar slidably couples with a vent pipe with the lower periphery coupled with the cone flashing thereof. Included in the device is a circular flange having an upper inner edge, a lower inner edge, and an outer edge. The upper inner edge extends outwardly and downwardly from the intermediate periphery of the rounded collar to the outer edge. The lower inner edge extends outwardly and downwardly from the lower periphery of the rounded collar to the outer edge. The circular flange serves to cover the flashing cone to protect the flashing cone from rain and weather.

1 Claim, 4 Drawing Sheets

FIG 3
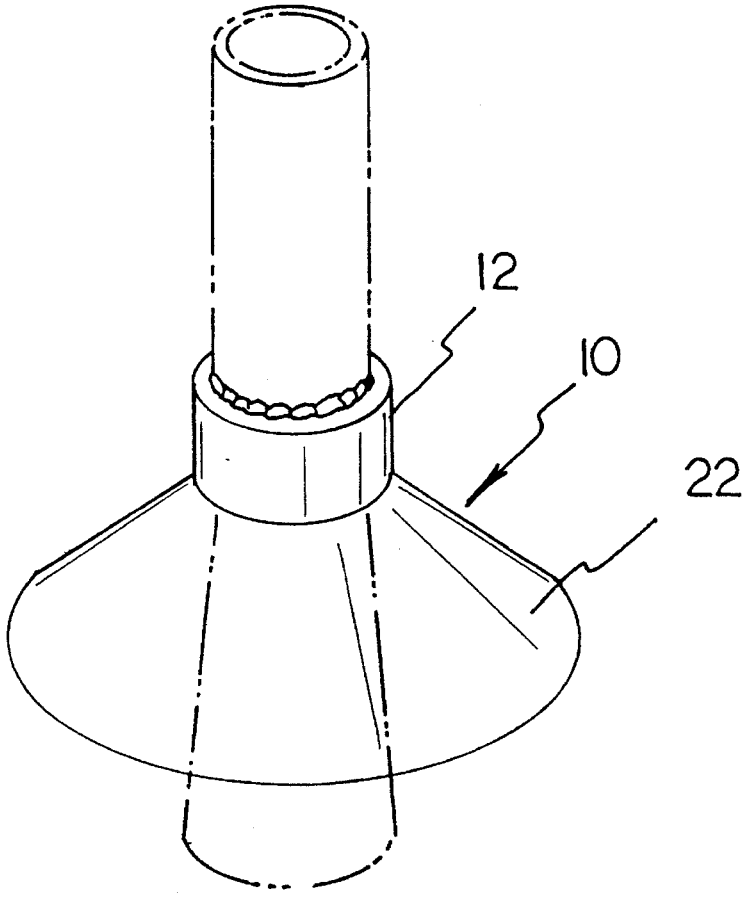
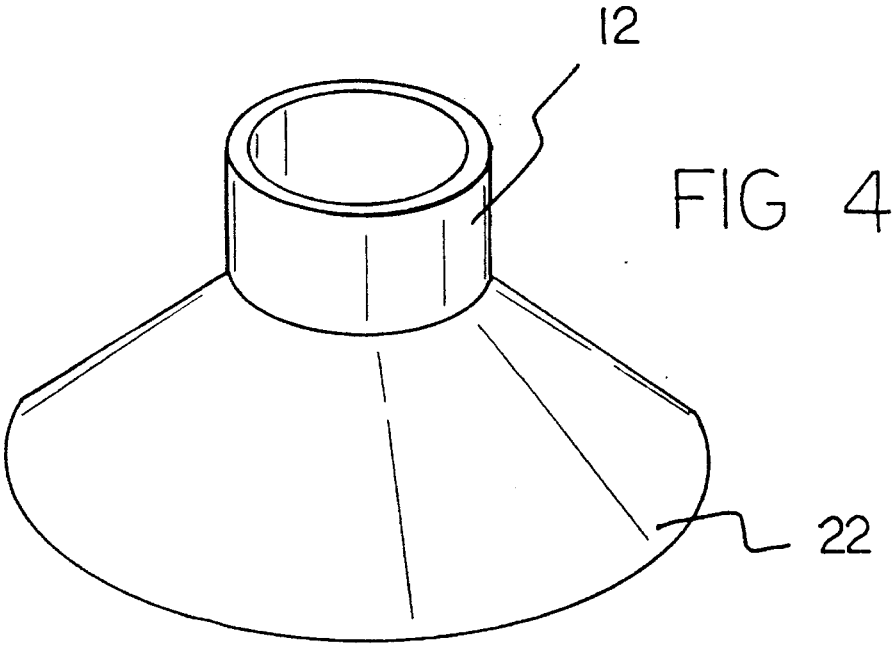
FIG 4

FIG 7
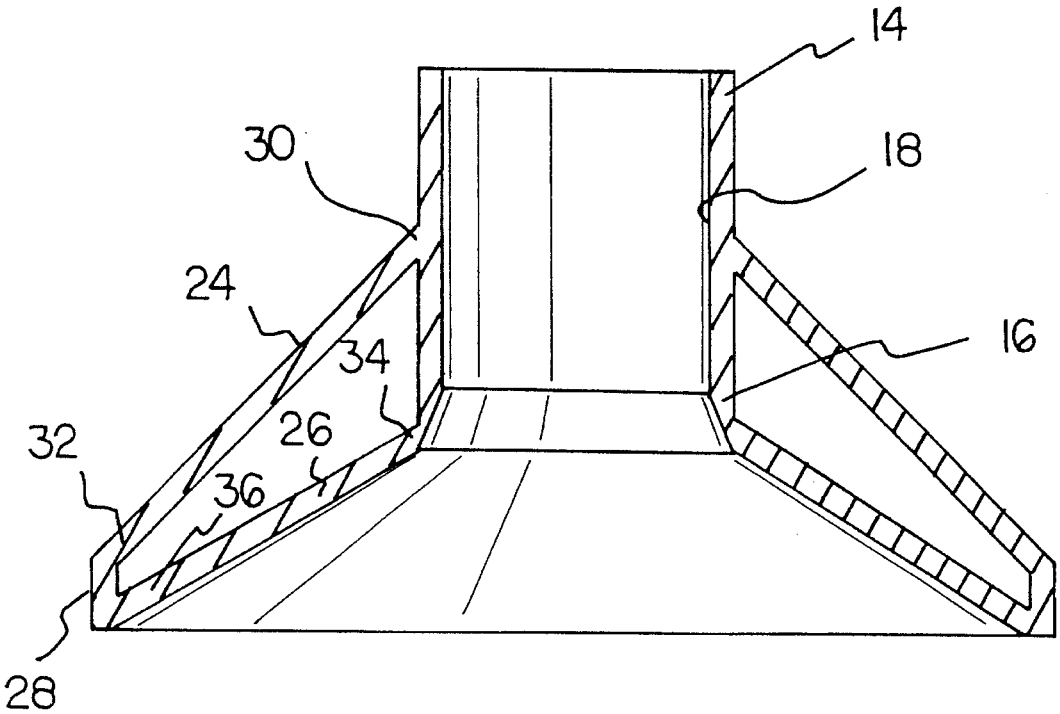
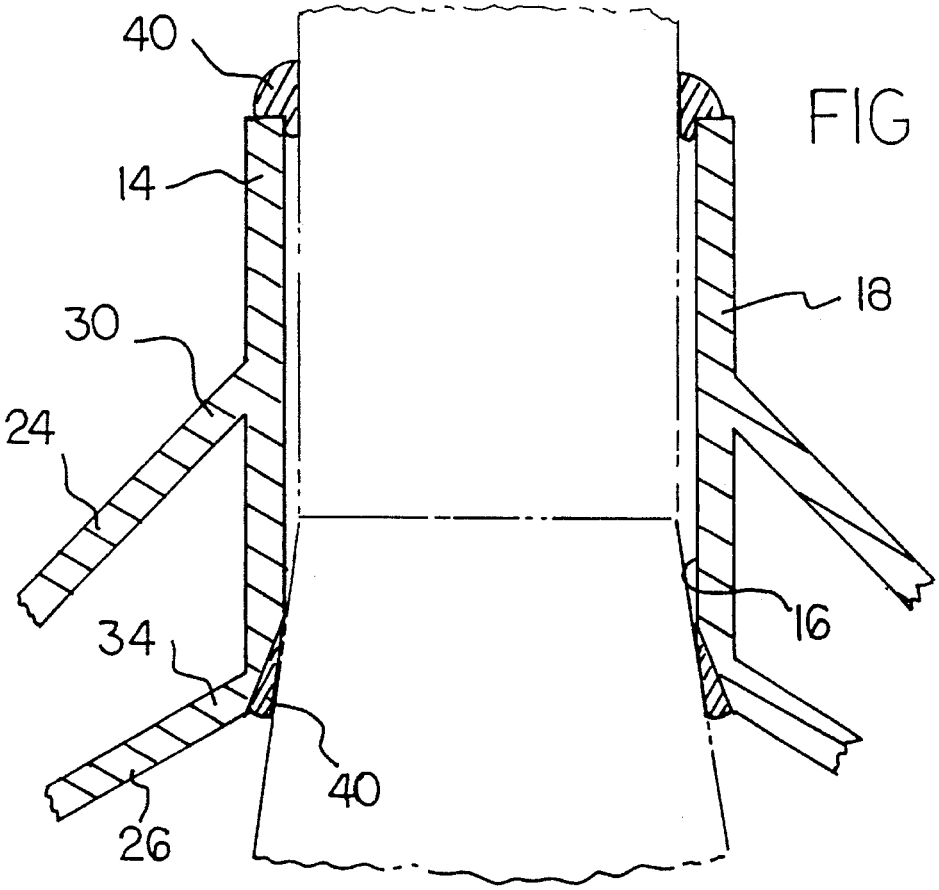
FIG 8

STORM COLLAR FOR VENTING HIGH EFFICIENCY FURNACES

BACKGROUND OF THE INVENTION

1. Field of the Invention

The present invention relates to a storm collar for venting high efficiency furnaces and more particularly pertains to diverting rain away from a cone flashing of the furnace with a storm collar for venting high efficiency furnaces.

2. Description of the Prior Art

The use of vent collars is known in the prior art. More specifically, vent collars heretofore devised and utilized for the purpose of distributing heat and air from a furnace pipe are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,226,263 to Merrin et al. discloses a weather-tight roof flashing shield.

U.S. Pat. No. 5,222,334 to Hasty discloses a multiple size vent-pipe elastomeric collar.

U.S. Pat. No. 5,149,142 to Walko et al. discloses a vent collar for plastic lined pipe.

U.S. Pat. No. 4,275,707 to Anderson discloses a ventilating system collar with lock means.

U.S. Pat. No. 4,120,129 to Nagler et al. discloses a pipe flashing unit.

While these devices fulfill their respective, particular objective and requirements, the aforementioned patents do not describe a storm collar for venting high efficiency furnaces for diverting rain away from a cone flashing of the furnace.

In this respect, the storm collar for venting high efficiency furnaces according to the present invention substantially departs from the conventional concepts and designs of the prior art, and in doing so provides an apparatus primarily developed for the purpose of diverting rain away from a cone flashing of the furnace.

Therefore, it can be appreciated that there exists a continuing need for new and improved storm collar for venting high efficiency furnaces which can be used for diverting rain away from a cone flashing of the furnace. In this regard, the present invention substantially fulfills this need.

SUMMARY OF THE INVENTION

In the view of the foregoing disadvantages inherent in the known types of vent collars now present in the prior art, the present invention provides an improved storm collar for venting high efficiency furnaces. As such, the general purpose of the present invention, which will be described subsequently in greater detail, is to provide a new and improved storm collar for venting high efficiency furnaces and method which has all the advantages of the prior art and none of the disadvantages.

To attain this, the present invention essentially comprises a rounded collar having an upper periphery, a lower periphery, and an intermediate periphery therebetween. The lower periphery has a diameter slightly greater than that of the intermediate periphery and the upper periphery. The rounded collar slidably couples with a vent pipe with the lower periphery coupled with the cone flashing thereof. The device contains a circular flange having an upper inner edge, a lower inner edge, and an outer edge. The upper inner edge has a first end and a second end. The first end is secured to the intermediate periphery of the rounded collar. The second end extends outwardly and downwardly to the outer edge. The lower inner edge has a first end and a second end. The first end is secured to the lower periphery of the rounded collar. The second end extends outwardly and downwardly to the outer edge. The circular flange serves to cover the flashing cone to protect the flashing cone from rain and weather. The device contains PVC glue that is applicable to the vent pipe corresponding to the position of the upper periphery of the rounded collar to the vent pipe and corresponding to the position of the lower periphery of the rounded collar to the vent pipe. The PVC glue serves to provide a waterproof seal for the rounded collar and the circular flange to the vent pipe.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved storm collar for venting high efficiency furnaces which has all the advantages of the prior art vent collars and none of the disadvantages.

It is another object of the present invention to provide a new and improved storm collar for venting high efficiency furnaces which may be easily and efficiently manufactured and marketed.

It is a further object of the present invention to provide a new and improved storm collar for venting high efficiency furnaces which is of durable and reliable construction.

An even further object of the present invention is to provide a new and improved storm collar for venting high efficiency furnaces which is susceptible of a low cost of manufacture with regard to both materials and labor, and which accordingly is then susceptible of low prices of sale to the consuming public, thereby making such a storm collar for venting high efficiency furnaces economically available to the buying public.

Still yet another object of the present invention is to provide a new and improved storm collar for venting high efficiency furnaces which provides in the apparatuses and methods of the prior art some of the advantages thereof, while simultaneously overcoming some of the disadvantages normally associated therewith.

Even still another object of the present invention is to provide a new and improved storm collar for venting high efficiency furnaces for diverting rain away from a cone flashing of the furnace.

Lastly, it is an object of the present invention to provide a new and improved storm collar for venting high efficiency furnaces comprising a rounded collar having an upper periphery, a lower periphery, and an intermediate periphery therebetween. The rounded collar slidably couples with a vent pipe with the lower periphery coupled with the cone flashing thereof. Included in the device is a circular flange having an upper inner edge, a lower inner edge, and an outer edge. The upper inner edge extends outwardly and downwardly from the intermediate periphery of the rounded collar to the outer edge. The lower inner edge extends outwardly and downwardly from the lower periphery of the rounded collar to the outer edge. The circular flange serves to cover the flashing cone to protect the flashing cone from rain and weather.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective view of the present invention in place on a cone flashing unit.

FIG. 4 is a perspective view of the preferred embodiment of the storm collar for venting high efficiency furnaces constructed in accordance with the principles of the present invention.

FIG. 7 is a cross-sectional view as seen along line 7—7 of FIG. 6.

FIG. 8 is a partial view of the present invention as it is coupled with the cone flashing unit.

The same reference numerals refer to the same parts through the various Figures.

DESCRIPTION OF THE PREFERRED EMBODIMENT

Figure 1:
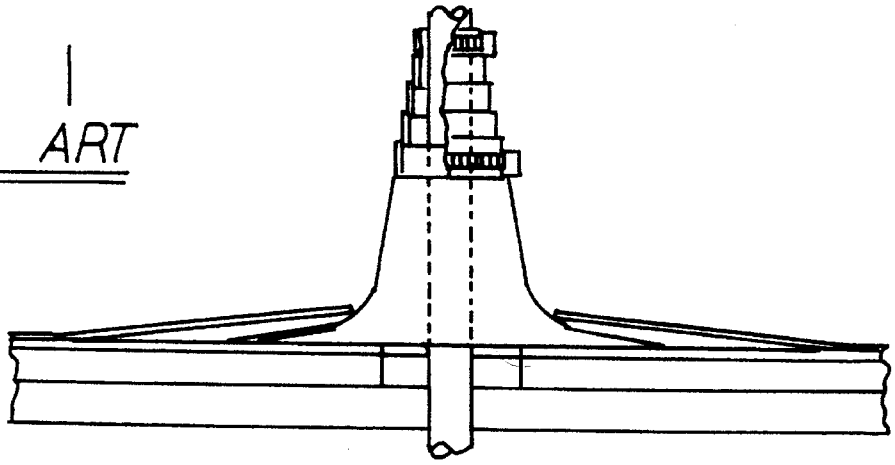
FIG 1 PRIOR ART
FIG. 1 is a front elevation of the prior art pipe flashing unit.
Figure 2:
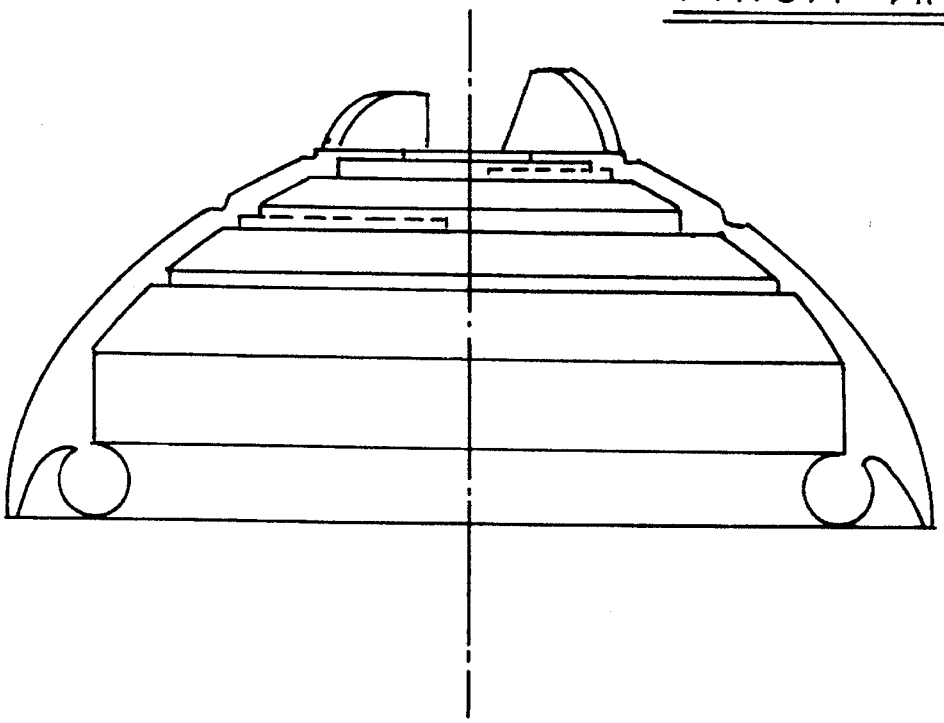
FIG 2 PRIOR ART
FIG. 2 is a front elevation view of the prior art multiple size vent-pipe elastomeric collar.
Figure 5:
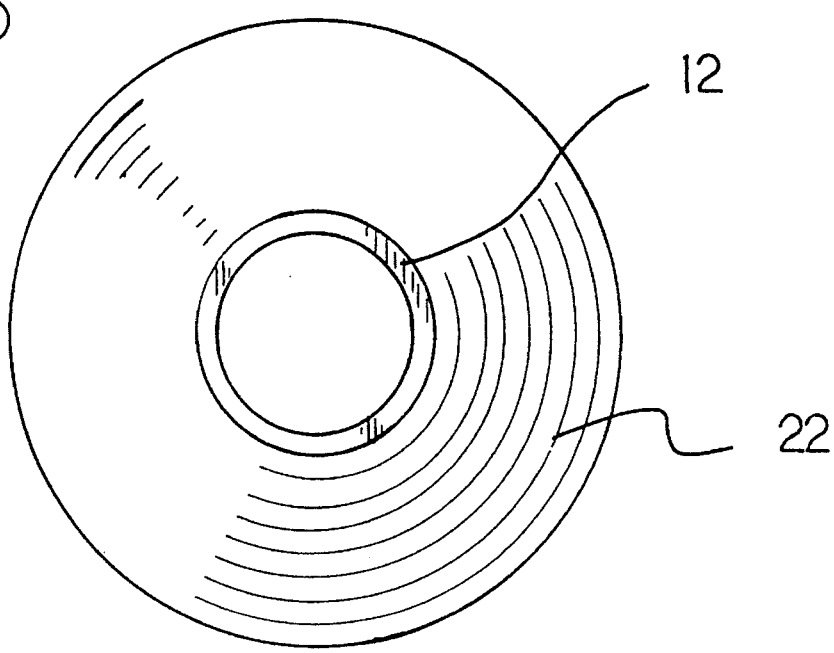
FIG. 5 is a top view of the preferred embodiment of the present invention.
Figure 6:
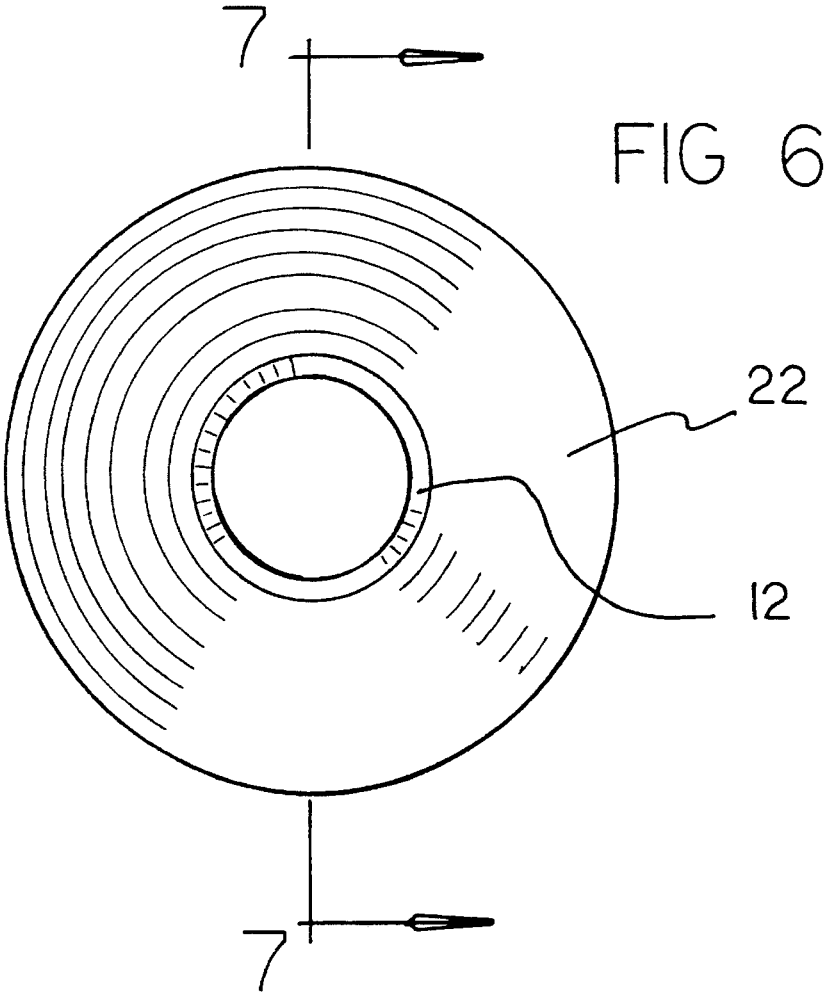
FIG. 6 is a bottom view of the preferred embodiment of the present invention.

With reference now to the drawings, and in particular, to FIG. 1 thereof, the preferred embodiment of the new and improved storm collar for venting high efficiency furnaces embodying the principles and concepts of the present invention and generally designated by the reference number 10 will be described.

Specifically, it will be noted in the various Figures that the device relates to a new and improved storm collar for venting high efficiency furnaces for diverting rain away from a cone flashing of the furnace. In its broadest context, the device consists of a rounded collar, a circular flange, and PVC glue.

The device 10 contains a rounded collar 12 having an upper periphery 14, a lower periphery 16, and an intermediate periphery 18 therebetween. The lower periphery 16 has a diameter slightly greater than that of the intermediate periphery 18 and the upper periphery 14. The rounded collar 12 slidably couples with a vent pipe with the lower periphery 16 coupled with the cone flashing thereof. The-rounded collar 12 is constructed of PVC or ABS plastic. The diameter of the rounded collar 12 is slightly greater than that of the vent pipe to allow the collar 12 to be easily coupled with the vent pipe, but still providing a snug fit.

The device 10 contains a circular flange 22 having an upper inner edge 24, a lower inner edge 26, and an outer edge 28. The upper inner edge 24 has a first end 30 and a second end 32. The first end 30 is secured to the intermediate periphery 18 of the rounded collar 12. The second end 32 extends outwardly and downwardly to the outer edge 28. The lower inner edge 26 has a first end 34 and a second end 36. The first end 34 is secured to the lower periphery 16 of the rounded collar 12. The second end 36 extends outwardly and downwardly to the outer edge 28. The circular flange 22 serves to cover the flashing cone to protect the flashing cone from rain and weather. The angle that the upper inner edge 24 extends downwardly from the rounded collar 12 is about forty-five degrees.

The device 10 contains PVC glue 40 that is applicable to the vent pipe corresponding to the position of the upper periphery 14 of the rounded collar 12 to the vent pipe and corresponding to the position of the lower periphery 16 of the rounded collar 12 to the vent pipe. The PVC glue 40 serves to provide a waterproof seal for the rounded collar 12 and the circular flange 22 to the vent pipe.

The present invention is a collar for use with PVC or ABS vent pipes which helps to divert rain away from the cone flashing, to reduce the chance of leaks.

The device 10 consists of a round collar 12 with a circular flange 22 running around its circumference. The bottom edge of the collar 12 is angled out slightly, while the inner diameter of the collar 12 is slightly larger than the PVC or ABS vent pipe. The flange 22 extends at an angle so that the outer edges slope downward and outward. When the flange 22 and collar 12 are assembled, the device 10 measures a total of seven inches in diameter.

The collar 12 is installed by sliding it down over the vent pipe. Since the bottom edge of the collar 12 is angled out slightly, it will fit snugly over the top of the flashing cone. The final location of the collar 12 is marked, after it has been snugly seated. It is then removed, and the appropriate adhesive is applied to the exterior surface of the pipe, and the interior surface of the unit. The collar 12 is then slid back down on the pipe and rotated to ensure a waterproof seal.

The angle of the flange 22 on the collar 12 helps to divert water away from the cone flashing on vent pipes, so that the water does not leak in around the flashing where it joins the pipe. The present invention makes installing pipes faster and simpler because the device 10 slides on easier than the coupling which is normally used.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention, Therefore, the foregoing is considered as illustrative only of the principles of the invention. Further, since numerous modification and changes will readily occur to those skilled in the art, it is not desired to limit the=invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved storm collar for venting high efficiency furnaces for diverting rain away from a cone flashing of the furnace comprising, in combination:

a rounded collar having an upper periphery, a lower periphery, and an intermediate periphery therebetween, the lower periphery having a diameter slightly greater than that of the intermediate periphery and the upper periphery, the rounded collar slidably coupled with a vent pipe with the lower periphery coupling with the cone flashing thereof;

a circular flange having an upper inner edge, a lower inner edge, and an outer edge, the upper inner edge having a first end and a second end, the first end secured to the intermediate periphery of the rounded collar, the second end extending outwardly and downwardly to the outer edge, the lower inner edge having a first end and a second end, the first end secured to the lower periphery of the rounded collar, the second end extending outwardly and downwardly to the outer edge, the circular flange serving to cover the flashing cone to protect the flashing cone from rain and weather, the upper inner end extends at a forty-five degree angle from the rounded collar;

PVC glue appliable between the upper periphery of the rounded collar and the vent pipe and between the lower periphery of the rounded collar and the vent pipe, the PVC glue serving to provide a waterproof seal for the rounded collar and the circular flange to the vent pipe.

* * * * *